United States Patent [19]

Reed et al.

[11] 4,192,241

[45] Mar. 11, 1980

[54] APPARATUS FOR QUILTING LAYERED FABRICS

[76] Inventors: Donald K. Reed; Shere R. Reed, both of 1713 32nd St., Lubbock, Tex. 79411

[21] Appl. No.: 942,669

[22] Filed: Sep. 15, 1978

[51] Int. Cl.[2] ..... D05B 11/00

[52] U.S. Cl. ..... 112/117; 112/119; 112/121.14

[58] Field of Search ..... 112/117, 118, 119, 121.14, 112/80, 121.26

[56] References Cited

U.S. PATENT DOCUMENTS

| | | | |
|---|---|---|---|
| 182,096 | 9/1876 | Barton | 112/117 |
| 236,466 | 1/1881 | Thomas | 112/117 |
| 540,348 | 6/1895 | Bartlett | 112/117 |
| 803,508 | 10/1905 | Robb | 112/117 |
| 871,315 | 11/1907 | Wittwer | 112/119 |
| 1,212,516 | 1/1917 | Lemons | 112/119 |
| 1,329,411 | 2/1920 | Kanta et al. | 112/117 |
| 1,623,075 | 4/1927 | Thomas | 112/117 X |
| 2,059,845 | 11/1936 | Bowersox | 112/117 |
| 2,163,304 | 6/1939 | Corrall et al. | 112/121.14 |
| 3,044,426 | 7/1962 | Schwarzberger | 112/117 |

*Primary Examiner*—H. Hampton Hunter
*Attorney, Agent, or Firm*—Hill, Van Santen, Steadman, Chiara & Simpson

[57] ABSTRACT

Apparatus for quilting layered fabrics by a sewing machine. The fabric and liner are unrolled from parallel fabric and liner shafts onto a winding shaft for the quilted fabric and disposed beneath the carrier arm of the sewing machine carriage. A hand control for free-hand quilting may be extensible from the sewing machine head and retracted during pattern quilting. The sewing machine carriage is mounted on parallel rails extending transversely of the pattern on linear anti-friction bearings. Other parallel rails and anti-friction linear bearings extending longitudinally of the pattern also mount the linear bearings and carriage for movement longitudinally of the fabric to be quilted. A follower depends from the sewing machine carriage to engage and follow the pattern and controls movement of the carriage to conform to the pattern selected for quilting. The fabric and liner shafts may be adjusted and rotated to maintain the required tension on the material being quilted, and to assure a completed quilt free from wrinkles.

14 Claims, 7 Drawing Figures

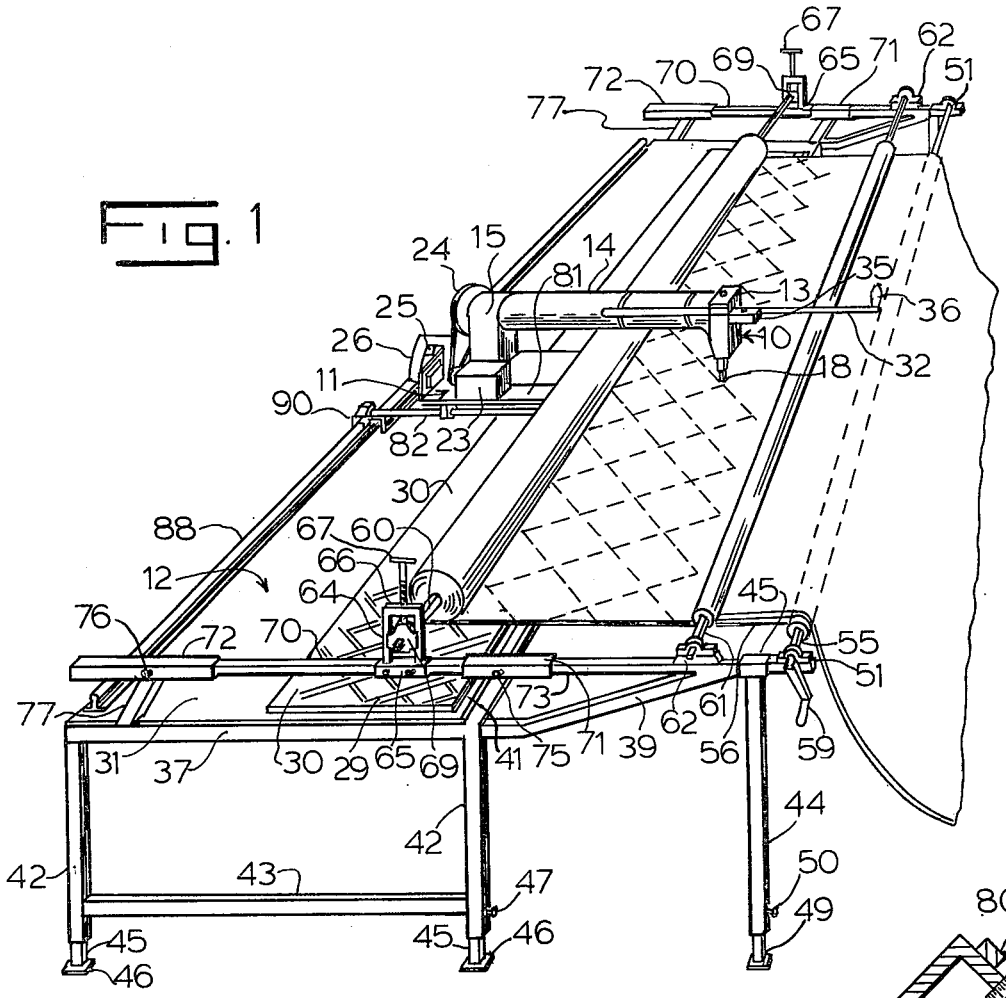
Fig. 1
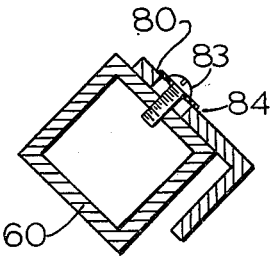
Fig. 3
Fig. 2
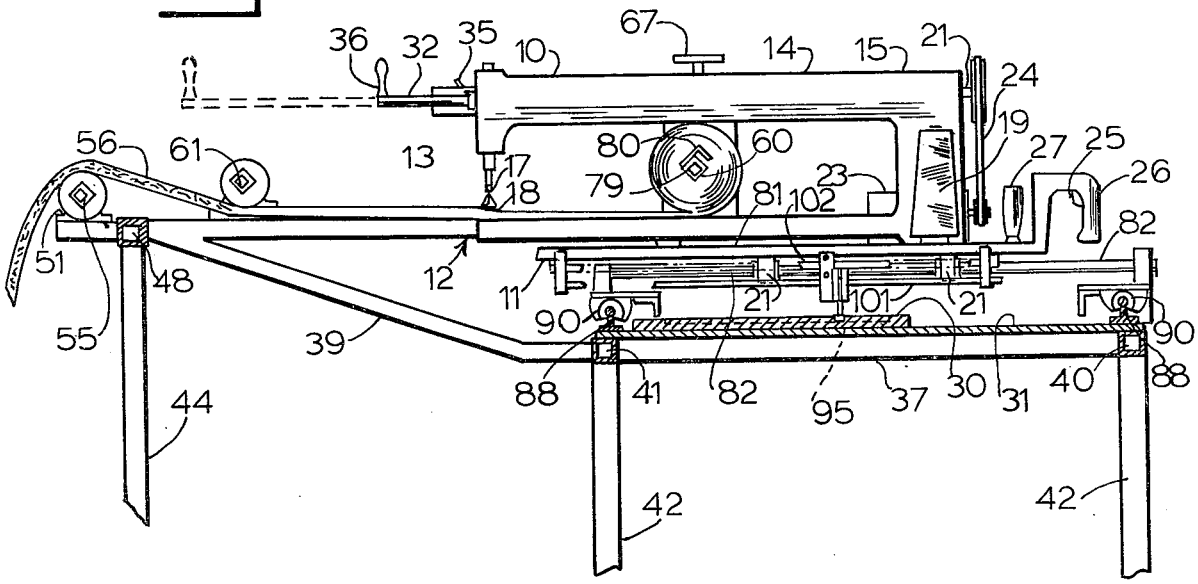

91
91
40
88
12
VI
82
26
82
VI
27
16
30
21
102
23
98
29
21
14
90
41
91
88
11
81
35
10
13
32
36
61

VII
106
102
98
101
99
100
97
95
29
96
VII 106
105
102
81
11
104
91
98
86
86
103
85
100
82
101
97
95
30
96
29

20
21
19
26
16
24
23
27
81
V
11
100
94
102
103
85
85
94
99
101
82
82
93
98
91
88
91
90
29
97
30
95
31
90
V
40

APPARATUS FOR QUILTING LAYERED FABRICS

BACKGROUND, SUMMARY AND ADVANTAGES OF INVENTION

Heretofore, quilting has been done by stretching a fabric, filler and liner between the sides of an open rectangular quilting frame and then using a sewing machine to stitch a pattern through the fabric, filler and liner either under manual control or to follow a selected pattern. Such quilting operations usually require more than one person to maintain the layered material smooth and free from wrinkles. This increases the cost of quilting, making such quilting operations more expensive than desirable and ending up with a complicated machine and an expensive product.

By the present invention, we provide a simplified quilting machine which requires a minimum stretching of the material to put it in condition for quilting and enables a single operator to load a winding drum of the machine with fabric, filler and liner, place the material under tension, and stitch a desired pattern either free-hand or by following a pattern, in which the sewing machine is moved in accordance with the pattern to be stitched, with little attention of the operator of the machine, except to load the winding drum, start and stop the machine, and follow the pattern, or quilt free-hand without a pattern.

An advantage of the invention is the provision of a simpler quilting machine in which quilting may be done by a single person either free-hand or under the control of a pattern.

A further advantage is the provision of a quilting machine maintaining the fabric, liner and filler free from wrinkles simply by winding the fabric, liner and filler onto a one-direction winding drum and unwinding the fabric and liner from one-direction supply drums placing sufficient tension on the fabric and liner to free the material from wrinkles and bunching up during the quilting operation.

A further advantage of the invention is in the adjustability of the supply shafts and winding shaft relative to each other and the vertical adjustment of the winding shaft to conform to the diameter of the final quilted material.

A further advantage of the invention is in the provision of a pattern on a work table spaced from the material to be quilted so as not to interfere with the quilting of the material, but to control movement of the sewing machine head to follow the pattern.

A still further advantage of the invention is in the provision of a grooved pattern formed by a routing or like operation and positioned beneath and behind the material being quilted and in the provision of a ball bearing follower following the groove of the pattern and controlling movement of the sewing machine head to conform to the pattern.

A still further advantage of the invention is the mounting of the sewing machine head on linear anti-friction slides both for movement longitudinally and transversely of the material being quilted.

A still further advantage of the invention is the control for free-hand quilting extensible from the sewing machine head and retractable during pattern quilting, and to provide a pattern quilting control at the opposite side of the sewing machine carriage in proximity to the pattern, so the operator of the machine may view the pattern during the quilting operation, and control the speed of quilting as well as stop and start operation of the sewing machine.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure.

DESCRIPTION OF DRAWINGS

FIG. 1 is a perspective view of a quilting apparatus constructed in accordance with the principles of the present invention showing the free-hand control extended from the sewing machine carriage and showing a form of pattern on the table of the machine disposed beneath the material being quilted and in full view of the operator of the machine when pattern quilting;

FIG. 2 is a fragmentary view in side elevation of the machine shown in FIG. 1;

FIG. 3 is a fragmentary diagrammatic sectional view illustrating a form of clamp that may be used to clamp the fabric, liner and filler to the winding shaft;

DESCRIPTION OF INVENTION

Figure 4:
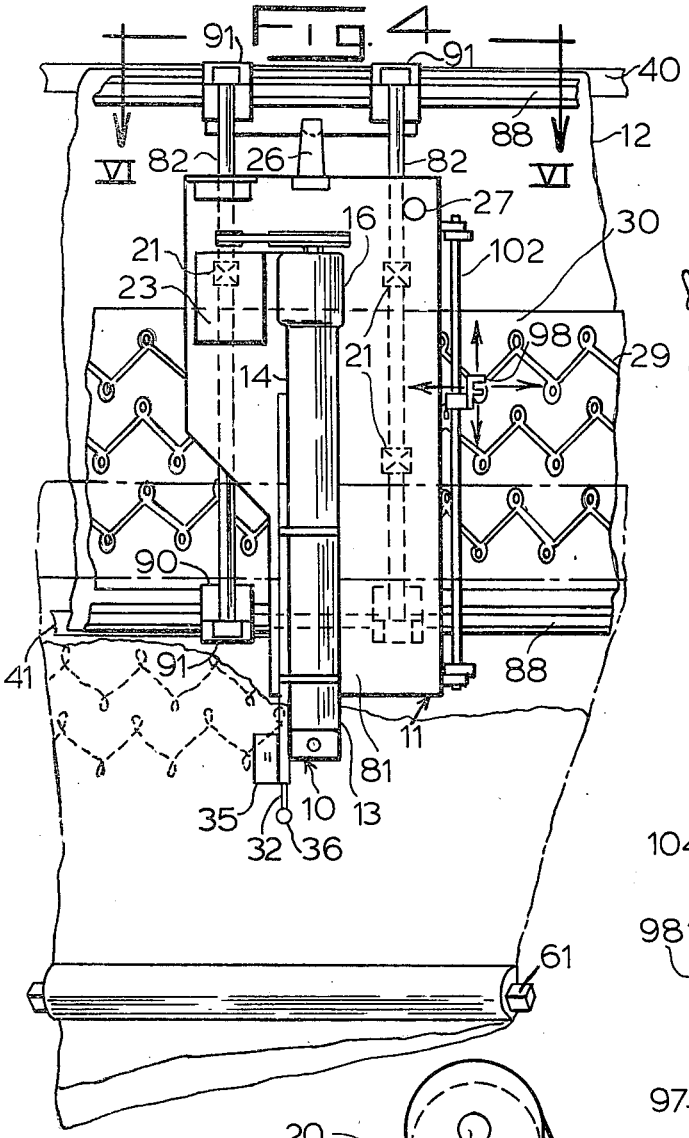
FIG. 4 is a fragmentary plan view of the machine shown in FIGS. 1 and 2 with a different pattern on the work table and looking down on the sewing machine head and its supports.

In the drawings, we have illustrated an apparatus for quilting multi-ply fabric by sewing a pattern in the fabric by a sewing machine 10 mounted on a carriage 11 mounted on a table 12 for free movement longitudinally and transversely of the table, to sew a selected pattern in the fabric.

The sewing machine 10 may be of any conventional form, and may be an underarm darning machine of a type manufactured by Chandler Machine Company. The sewing machine is shown as including a machine head 13 on the end of a hollow arm 14 extending from a support frame structure 15 mounted on the carriage 11 adjacent the end thereof farthest from the pattern to be sewed in the multi-ply fabric.

The sewing machine has a conventional reciprocating needle bar 17 and a pressure foot 18 through which a needle (not shown) extends in a conventional manner for sewing the pattern in the stretched multi-ply fabric. The thread is in the form of a frusto-conical roll of thread 19 rotatably mounted on a vertical spindle 20 and trained to the sewing machine needle (not shown) and fed to said needle by a conventional shuttle (not shown). The reciprocating needle bar 17 may be reciprocally driven by a shaft 21 extending along the hollow arm 14 and driven from a motor 23 mounted on the carriage 11. The drive from said motor 23 to said shaft 21 may be a suitable V-belt drive 24. The motor may be a variable speed motor and may be controlled by a switch 25 carried in a pistol grip handle 26. Said handle 26 cooperates with a handle 27 at one side of said handle 26 to control longitudinal and transverse movement of said carriage and sewing machine and cause the needle bar to follow a pattern 29. Said pattern 29 may be grooved and routed in a pattern board 30 extending along a flat top 31 of the table 12 for the length thereof in view of the operator of the machine and may be followed gripping the handles 26 and 27, to control the quilting of one section of the multi-layer fabric. Said pattern board 30 may be clamped or otherwise held from movement relative to said flat top 31 in a suitable manner.

Free-hand quilting may also be attained under the control of an extensible arm 32 extending along the hollow arm 14 beyond the machine head 13 toward the end of the table 12 opposite from the motor 23 and pistol grip 26 and switch 25. A switch 35, accessible from the extensible arm 32, adjacent the hand grip 36 on the outer end of the extensible arm 32, when said arm is retracted, may shut off the motor 23 during or at the termination of a free-hand quilting operation. The extensible arm may be releasably locked in its extended and retracted positions in a suitable manner, to effect movement of the carrier 11 and reciprocating needle bar 17, to stitch a desired pattern in the layered fabrics, free from the pattern 29 and pattern board 30.

Figure 5:
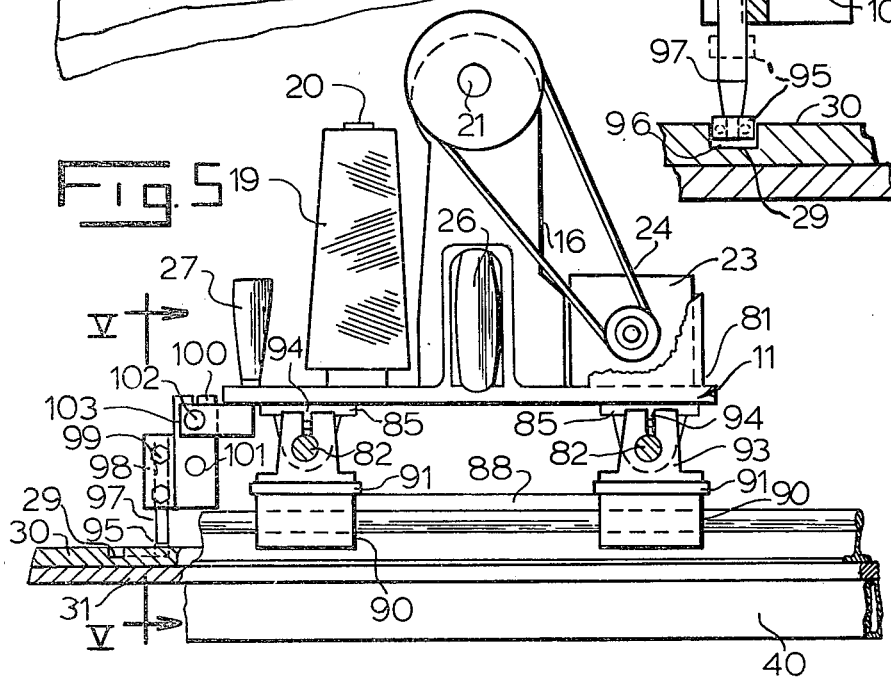
FIG. 5 is a fragmentary end view of the sewing machine head and a portion of the work table and pattern, and illustrating the mounting of the sewing machine head for movement longitudinally of the material being quilted.

Referring now to the table 12 as shown in FIGS. 1 and 2, said table may be an open rectangular structure, which may be formed from hollow rectangular bars 37 extending transversely of the table and having upwardly inclined portions 39 forming upward continuations thereof. The bars 37 may be connected together by hollow rectangular bars 40 and 41 (FIGS. 4 and 5). The framework comprising the parallel hollow rectangular bars 37, 40 and 41 and the upwardly inclined hollow rectangular bars 39 may be supported on parallel legs 42, 42 connected together by cross bars 43 adjacent the lower ends thereof. The ends of the bars 39 may be supported on legs 44 depending from yokes 48 suitably mounted on horizontal end portions of the bars 39. The legs 42, 42 have rectangular bars 45 adjustably mounted therein and extending upwardly of feet 46, 46 supported on the ground. Set screws 47 or any other releasable securing means may be provided to hold the bars 45 in position on the legs 42 and 44, to maintain the table top 31 level, or at an elevation convenient for the operator of the machine.

In a like manner, the legs 44 may have adjustable bars 49 adjustably mounted therein and held in position by set screws 50. If desired, and where required for stability of the table, intermediate transverse bars like the bars 37 may be connected between the hollow bars 40 and 41 to rigidify the table. As shown in FIGS. 1 and 2, the horizontally extending ends of the upwardly inclined bars 39 may have bearing boxes 51 mounted thereon for unidirectional ratchet bearings (not shown) for a liner shaft 55 herein shown as being a squared shaft and having a liner 56 wound thereon. The square liner shaft 55 accommodates the turning of said shaft from either end thereof, to wind the liner 56 thereon by the use of a hand crank 59, which may be removably mounted on said shaft. The ratchet bearings may be of a well-known form such as the ratchet bearings manufactured by Fafnir and termed R.C.I bearings. Said ratchet bearings may hold the liner shaft from rotation in one direction to maintain the lining taut when wound on a winding shaft 60 for the completed quilted fabric and may be set to accommodate unwinding of the liner to be wound on the winding shaft 60. Between the shafts 55 and 60, is a square fabric shaft 61 rotatably mounted in bearing boxes 62 on ratchet bearings such as the Fafnir R.C.I bearings and not herein shown or described since they are no part of the present invention, except insofar as they form a means for ratcheting the fabric shaft 61 and holding the fabric taut between the shafts 60 and 61.

The ratchet bearings for the shaft 60 may be set in a direction opposite than the ratchet bearings for the shafts 55 and 61 to maintain the fabric and lining taut and are adjustably mounted in yokes 64 extending upwardly of sleeves 65 and connected together at their upper ends by a cross bar 66 to form, in effect, guide yokes for the ratchet bearings supporting the winding shaft 60. Adjustment screws 67 are shown as threaded in the cross bars 66. Said cross bars engage blocks 69 slidably guided in said yokes and forming supports for the ratchet bearings for opposite ends of the winding shaft 60.

The rectangular sleeves 65 may be slidably guided along bars 70, for adjustable movement therealong to conform to the pattern on the pattern board 30. The bars 70 are shown as being mounted at their opposite ends in sleeves 71 and 72. The sleeve 71 also extends about a horizontal bar 73 extending horizontally from the yoke 45 toward the pattern board 30. Said sleeve is held in position on the bar 70 as by a set screw 75 or any other suitable holding means. The bars 70 extending through the sleeves 72 are slidable relative to said sleeves and held in position by a suitable holding means such as set screws 76. Each sleeve 72 in turn is mounted on the upper end of an angular leg 77 at the control end of the apparatus and extending angularly upwardly of the bar 37 in a direction toward the winding drum 60. The bars 70 slidably mounted in the sleeves 71 and 72 may also afford a means for adjusting the winding drum shaft 60 relative to the fabric and liner shafts, in accordance with the width of the pattern on the pattern board 30, and the desired spacing between said winding drum and the fabric shaft 61.

The winding shaft 60 may be a square shaft having reduced squared ends to receive a crank (not shown), which may be the crank 59 to accommodate the initial winding of the fabric, filler and liner on said shaft. As shown in FIGS. 2 and 3, the winding shaft 60 is a square hollow shaft having a right-angled clip 80 extending therealong to clip the fabric, filler and liner to said shaft and wind the fabric, filler and liner on said shaft and maintain the fabric, filler and liner taut to enable the fabric, filler and liner to be smooth and free from wrinkles and bunching during the operation of sewing a pattern therealong.

The clip 80 is shown as being a right-angled clip slotted at various places therealong to receive round headed machine screws 83. Washers 84 are interposed between said machine screws and cooperate therewith to accommodate release of said clip and tightening of said clip to clamp the fabric, liner and filler to a side of said shaft, to be wound thereon or released therefrom. Said clip 80 is shown for illustrative purposes only and may be of various conventional forms suitable for the purpose described herein.

Referring now to the rectilinear slidable support for the sewing machine 10 and carriage 11 carrying said sewing machine, said carriage includes a support plate 81 mounted for transverse and linear movement along the table 12, above the pattern board 30, to accommodate the sewing machine needle bar 17 and pressure foot 18 to follow a pattern 29 routed in said pattern board 30.

Figure 6:
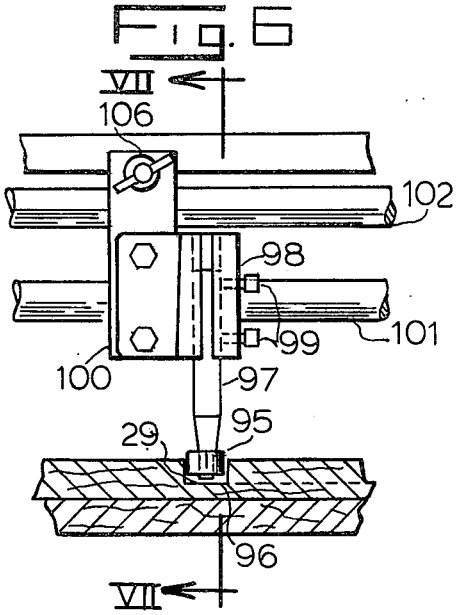
FIG. 6 is a fragmentary sectional view taken substantially along line VI—VI of FIG. 4 and illustrating the follower for pattern quilting, showing the follower following a grooved pattern.

The carriage 11 and support plate 81 are mounted on parallel shafts 82 extending transversely of the table 12 over the pattern board 30. As shown in FIG. 6, bearing boxes 85 are secured to the bottom of the plate 81 as by machine screws 86 or any other suitable securing means and form supports for linear bearings such as ball bushings of a commercial form and not herein shown or described since they form no part of the present invention except insofar as they support the machine carriage 11 on the transverse parallel shafts 82 for free linear movement therealong, and may be of a form termed PBO-120 OPN ball bushings manufactured by Fafnir and are purchased from Fafnir.

The parallel shafts 82 are supported at their opposite ends for free slidable movement along parallel rails 88, one of said rails extending longitudinally along the table 12 at one end of the flat top 31 for said table and the other of said rails being supported at the opposite end of said flat top 31 for said table.

Figure 7:
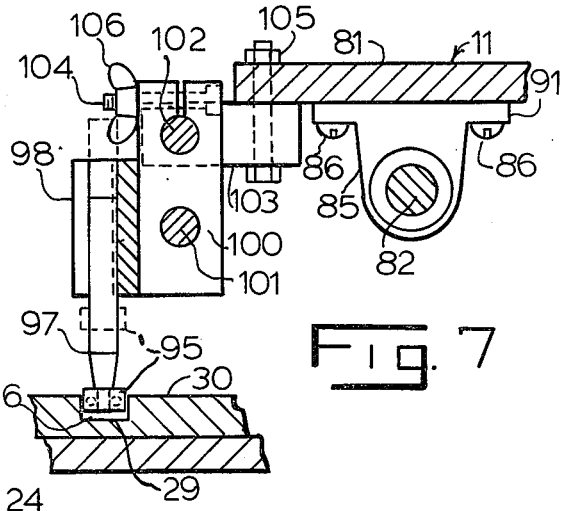
FIG. 7 is a fragmentary sectional view taken substantially along line VII—VII of FIG. 6.

As shown in FIGS. 5 and 7, ball bushing pillow blocks 90 are slidably mounted on the rails 88 for free slidable movement therealong. The ball bushing pillow blocks may be a commercial form PBO-120PN ball bushing pillow block manufactured by Fafnir and may have elongated and widened top portions 91 (FIG. 5) forming supports for clamping members 93, which may be secured thereto as by machine screws or other fastening devices. The clamping members 93 may be split as shown in FIG. 5 and tightened into engagement with the ends of the shafts 82 by a suitable securing means, which may be nuts and bolts, indicated generally by reference numeral 94. The sewing machine carriage may thus be mounted on the rails 88 for free slidable movement longitudinally of the quilt or material being quilted and for free movement transversely of the material being quilted.

With reference now to the means for causing the reciprocating needle bar and needle to follow a pattern in the pattern board 30, said pattern board may be made from wood or any other material and have any desired pattern formed therein as by routing, it being understood that the present pattern is exemplary only and may be formed to a selected pattern to be sewn in the quilting under the control of a follower roller 95 fitting in a groove 96 forming the pattern 29 and engaging one side of the groove to accommodate free rotation of said follower roller, as shown in FIG. 7.

It should be understood that the pattern need not be grooved as shown, but may be in the form of an embossment extending upwardly of the pattern board in which case two followers may be provided so as to engage each side of and follow the embossment. As shown in FIGS. 6 and 7, the follower roller 95 may be a ball bearing follower on the end of a spindle 97 depending from a bracket 98, which, in FIG. 5, is shown as being a split bracket. Said spindle 97 may be held in position on said bracket as by set screws 99 threaded in a split portion of said bracket and engaging the shank of the spindle 97. Said bracket 98 is shown in FIG. 5 as secured to one side of a bracket 100 as by machine screws or other suitable securing devices. The bracket 100 is shown in FIG. 6 as being carried by parallel shafts 101 and 102 suitably secured to a bracket 103 extending along the bottom of the support plate 81 to one side thereof. Nuts and bolts 105 or other securing means may be provided to secure the top face of the bracket 103 to the bottom surface of the plate 81.

As shown in FIG. 6, the bracket 100 has a split top portion opening to the shaft 102 which forms a means for clamping the bracket 100 to the shaft 102 or to release said clamping member to accommodate movement of said bracket and follower along the guide shafts 101 and 102. The securing means for securing said bracket in position on the shaft 102 is shown as comprising a thumb nut 106 on the end of a bolt or machine screw 104 extending through the bracket 100 and split portion thereof, to tighten said bracket to the shaft 102 or to release said bracket to accommodate adjustable movement of said bracket 100, spindle 97 and follower roller 95 about or along the shaft 102.

As previously mentioned, the bracket 98 being split and the spindle 97 being secured to said bracket as by machine screws 99, the elevation of the follower roller 95 may be varied in accordance with the elevation of the pattern on the pattern board 30 and may be entirely withdrawn from the pattern groove 96 and retained in position above said pattern groove for free-hand quilting.

During operation of the quilting apparatus, the fabric and liner with the filler therebetween, which for example, may be a dacron filler of sheet-like form, may be unwound from the fabric and liner shafts and the fabric, liner and filler between the fabric and liner may be clamped to the winding shaft 60 as by the clamp 80 extending for the length of said shaft. A section of fabric, filler and liner slightly wider than the width of a section of the portion of the fabric, liner and filler to be quilted may be stretched between the winding shaft 60 and the fabric and liner shafts 61 and 55 by turning the winding shaft 60 in a winding direction while holding the said fabric and liner shafts 55 and 61 from rotation. The winding shaft 60 may then be held from rotation in an unwinding direction by the ratchet bearings supporting said shaft and the ratchet bearings supporting the shafts 55 and 61 are set to accommodate the stretching of the fabric and liner as by the hand crank 59 fitting on the squared ends of said shafts to provide a section of quilting free from wrinkles. The follower roller 95 may then be placed in the groove 96 of the pattern 29 and the hands may grasp the hand grips 26 and 27. The sewing motor may be started and the hands may move the carriage 11 to cause said follower roller 95 to move along the pattern and thereby move the sewing machine needle to sew a selected pattern in the material being quilted. At the termination of the operation of quilting, the section of the fabric, liner and filler quilted may be wound on the winding shaft 60 to enable the pattern to be continued. These operations may be completed until a quilt of the required length has been sewn by releasing the ratchet bearings holding the fabric and liner shafts from rotation and by using the hand crank 59 to wind the section quilted onto the winding shaft 60. The ratchet bearings may then be set to accommodate the tensioning of the fabric and liner between the shafts 60, 61 and 55 by the hand crank 59, and the quilting operation may be continued.

It should be understood that during free-hand quilting, the extensible arm 32 may be extended from the sewing machine carriage and free-hand quilting may be done by grasping the handle 36 on the end of said arm and moving the sewing machine carriage 11, needle bar 17, pressure foot 18 and needle (not shown) to sew a selected pattern without the use of the pattern board 30 and follower roller 95. During free-hand quilting, the motor 23 may be controlled by the switch 35 and during pattern quilting, the quilting operation may be controlled to start and stop the sewing machine motor and vary the speed of said motor under the control of the switch 25 in the pistol grip 26.

It should be understood that the disclosure of the drawings is a diagrammatic disclosure only and that many features such as the ratchet bearings, which are commercial articles of manufacture, are not shown, in order to simplify the description and particularly since these ratchet bearings, as well as the linear slide bearings, may be purchased articles.

It should further be understood that with the fabric and liner wound on separate shafts and unwound therefrom to provide the material to be quilted with the filler therebetween and clamped to the winding shaft 60, and by the use of releasable reverse acting ratchet bearings, the desired tension on the material being quilted may be attained and the material may be held free from wrinkles without the use of the usual clamps, clamping the edges of the material being quilted, and that the apparatus may be set up and operated by one person, both for pattern and free-hand quilting, materially simplifying the setting up of the quilting operation and apparatus and moving the sewing machine head to effect the sewing of a selected pattern in the fabric, liner and filler.

We claim as our invention:

1. An apparatus for quilting layered fabrics, comprising:

a table, a winding shaft on said table extending for the length thereof, a fabric shaft spaced from said winding shaft a distance at least as great as a section of the pattern to be quilted, a liner shaft spaced from said fabric shaft and rotatably mounted on said table, clamping means on said winding shaft for clamping at least the fabric and liner thereto, means rotatably supporting said winding shaft for rotation in a winding direction, and selectively operable to hold said winding shaft from rotation in an unwinding direction, means mounting said fabric and liner shafts for rotation and selectively operable to hold said shafts from rotation in a direction to release tension on the fabric and liner, means for turning said fabric and liner shafts individually of each other for taking up tension on said fabric and liner and providing a taut section between said fabric shaft and winding shaft free from wrinkles, a sewing machine, a carriage for said sewing machine, supporting said sewing machine on said table for free movement longitudinally and transversely of said table, said sewing machine having a reciprocating needle bar and pressure foot pressed into engagement with the fabric, a motor for driving said sewing machine, control means for said motor, and means accommodating manual movement of said sewing machine longitudinally and transversely of said table to sew a selected pattern in said fabric and liner, comprising an extensible and retractable control arm accessible from one side of the table.

2. The apparatus for quilting layered fabrics of claim 1, wherein the manual control means includes a pistol grip on said extensible and retractable control arm for moving the follower along a pattern and a switch accessible from said pistol grip for starting and stopping operation of said sewing machine.

3. The quilting apparatus of claim 1, wherein a pattern board and pattern are provided in full view of the operator grasping said pistol grip and a second control spaced from said pistol grip is provided to enable the operator to use both hands to move said sewing machine to follow the pattern in said pattern board.

4. The quilting apparatus of claim 3, including a spindle depending from said sewing machine carriage and means for mounting said anti-friction roller for free rotation on said spindle, and said spindle and roller being movable into a retracted position relative to said pattern, upon free-hand quilting.

5. The quilting apparatus of claim 4, wherein said extensible and retractable arm is extended from the end of the sewing machine facing said liner and fabric shafts and retracted to extend along the sewing carriage when not in use.

6. The quilting apparatus of claim 1, wherein the fabric to be quilted also includes a filler of a flat, sheet-like elongated form between the fabric and liner, the clamping means on said winding shaft also serves to clamp said filler to said winding shaft to be wound thereon with said fabric and liner, and said fabric, filler and liner are maintained under tension by said winding, fabric and liner shafts, each cooperating with the other to maintain a taut quilting section between said winding shaft and said fabric shaft.

7. The quilting apparatus of claim 6, including a pattern board disposed beneath said winding shaft, means for manually moving said sewing machine and follower along the pattern in said pattern board to guide the sewing machine reciprocating needle bar and needle to sew a pattern conforming to the pattern on said pattern board, and means accessible from said extensible and retractable arm for controlling operation of the sewing machine needle bar and needle carried thereby.

8. The apparatus of claim 7, wherein the pattern is on one side of said table in full view of the operator of the machine, means are provided for mounting said follower to be moved to an elevated position out of engagement with said pattern, and free-hand control means is provided for moving said sewing machine carriage from the side of said table remote from said pattern and is extensible from said sewing machine head during free-hand pattern sewing and retractable with respect thereto during pattern sewing under control of the operator of the machine.

9. An apparatus for quilting layered fabrics, including a fabric, a liner, and a filler therebetween, an elongated table, a pair of parallel rails extending longitudinally of said table, slide bearings mounted on said rails for free movement therealong, a carriage mounted on said slide bearings for movement along said rails and table, the mounting for said carriage on said slide bearings including slide bearings mounted on said first-mentioned slide bearings and mounting said carriage for free movement transversely of said table, a sewing machine mounted on said carriage and including a support structure extending upwardly of one side of said carriage, a hollow arm extending from said support structure along said carriage, a sewing machine head at the end of said hollow arm opposite from said support structure and including a reciprocating needle bar and a pressure foot pressed into engagement with the fabric being quilted, a pattern on said table disposed beneath and to one side of a section of fabric being quilted, a follower mounted on said carriage for engagement with said pattern for movement therealong to guide said sewing machine head and reciprocating needle bar to conform to a pattern on said pattern board, means for moving said follower along said pattern by hand from one side of said table, and means at the opposite side of said table for moving said sewing machine head and reciprocating needle bar for free-hand pattern sewing free from said pattern.

10. The quilting apparatus of claim 9, characterized by a winding shaft extending longitudinally of said table a distance greater than the width of the layered fabric, parallel fabric and liner shafts spaced from said winding shaft and rotatably mounted on said table, said winding shaft being selectively operable in a direction to wind fabric on said winding shaft, said liner shaft and fabric shaft being rotatable in the same direction as said winding shaft, and selectively held from rotation in unwinding directions, clamping means on said winding shaft for clamping the fabric and liner with the filler therebetween to said winding shaft, removable means rotatably driving said winding shaft, fabric and liner shafts in winding directions, and said winding, liner and fabric shafts being held from rotation in unwinding directions.

11. The quilting apparatus of claim 10, in which the means for rotating said winding shaft in a winding direction comprises a hand crank removably mounted on the end of said shaft and operable to rotate said fabric and liner shafts.

12. The quilting apparatus of claim 10, including an extensible and retractable control arm for moving said sewing machine carriage, reciprocating needle bar and pressure foot to sew a pattern on a section of layered fabric between said winding shaft and fabric shaft by hand, and a switch accessible from said control arm for starting and stopping said sewing machine motor.

13. The quilting apparatus of claim 10, including a pattern board extending longitudinally of said table and having a pattern formed thereon and a follower depending from said sewing machine carriage positionable to engage the pattern on said pattern board and positionable out of engagement with said pattern during free-hand quilting.

14. The quilting apparatus of claim 13, wherein the pattern board is disposed beneath said winding shaft and manually operable means engaging said sewing machine carriage are provided for moving said follower along said pattern and moving said sewing machine to sew a pattern in the layered fabric between said winding shaft and said fabric shaft in accordance with the pattern on said pattern board.

* * * * *